US008920071B2

(12) United States Patent
Luneckas et al.

(10) Patent No.: US 8,920,071 B2
(45) Date of Patent: Dec. 30, 2014

(54) APPARATUS AND METHOD FOR LIMITING ICE FORMATION

(75) Inventors: Darin Luneckas, Cedar Rapids, IA (US); Steve Kunert, Cedar Rapids, IA (US); Blayne Medema, Cedar Rapids, IA (US)

(73) Assignee: Hazard Mitigation, Inc., Cedar Rapids, IA (US)

( * ) Notice: Subject to any disclaimer, the term of this patent is extended or adjusted under 35 U.S.C. 154(b) by 557 days.

(21) Appl. No.: 13/227,057

(22) Filed: Sep. 7, 2011

(65) Prior Publication Data

US 2013/0058723 A1 Mar. 7, 2013

(51) Int. Cl.

| | |
|---|---|
| ***E02B 3/02*** | (2006.01) |
| ***B67D 7/78*** | (2010.01) |
| ***E03F 1/00*** | (2006.01) |
| ***E04D 13/08*** | (2006.01) |

(52) U.S. Cl.

CPC ..... *E04D 13/08* (2013.01); *E04D 2013/0813* (2013.01)

USPC ..... 405/80; 405/52; 405/118; 405/119

(58) Field of Classification Search

USPC ..... 405/80, 118, 119, 52; 251/127; 138/42

See application file for complete search history.

(56) References Cited

U.S. PATENT DOCUMENTS

| | | | | | |
|---|---|---|---|---|---|
| 118,699 | A | * | 9/1871 | Doane | 405/118 |
| 167,636 | A | * | 9/1875 | Bogen | 165/65 |
| 593,930 | A | * | 11/1897 | Fraser | 126/296 |
| 668,953 | A | * | 2/1901 | Dawson | 261/144 |
| 679,965 | A | * | 8/1901 | Van Holdt | 405/118 |
| 856,702 | A | * | 6/1907 | Howley | 404/2 |
| 973,442 | A | * | 10/1910 | Lees | 405/118 |
| 1,024,688 | A | * | 4/1912 | Lewis | 181/272 |
| 1,065,239 | A | * | 6/1913 | Gudeman | 184/55.1 |
| 1,144,306 | A | * | 6/1915 | Mock | 181/279 |
| 1,195,044 | A | * | 8/1916 | Lockwood | 127/12 |
| 1,355,527 | A | * | 10/1920 | Banta | 48/189.3 |
| 1,397,708 | A | * | 11/1921 | Stowell | 405/118 |
| 1,415,274 | A | * | 5/1922 | Stowell | 52/569 |
| 1,515,709 | A | * | 11/1924 | Stowell | 405/118 |
| 1,527,889 | A | * | 2/1925 | Link | 62/435 |
| 1,559,344 | A | * | 10/1925 | Modlin, Jr. | 48/107 |
| 1,645,601 | A | * | 10/1927 | Lee | 251/122 |
| 1,672,349 | A | * | 6/1928 | Sherrod | 137/614.2 |
| 1,673,619 | A | * | 6/1928 | Culp | 137/527 |
| 1,720,245 | A | * | 7/1929 | Smith | 48/189.4 |
| 1,720,246 | A | * | 7/1929 | Smith | 48/189.4 |
| 1,845,640 | A | * | 2/1932 | Wescott | 62/527 |
| 1,975,594 | A | * | 10/1934 | Stroud et al. | 196/46 |
| 2,069,714 | A | * | 2/1937 | Getchell | 138/42 |
| 2,178,564 | A | * | 11/1939 | Crocker | 137/263 |
| 2,196,035 | A | * | 4/1940 | Shaw | 312/213 |

(Continued)

*Primary Examiner* — Benjamin Fiorello
*Assistant Examiner* — Edwin Toledo-Duran
(74) *Attorney, Agent, or Firm* — Ryan N. Carter

(57) ABSTRACT

A container adapted to be placed near a walkway or road and adapted to receive a solid ice prevention composition such as salt pellets. The container has an entrance opening and an exit opening. The entrance opening of the container may be connected to a downspout directly or via a connecting member to direct water from the downspout into the container. Water enters the container through the entrance opening and mixes with the ice prevention composition to create a solution having a reduced freezing point. The solution exits the container through the exit opening where it is able to flow in its liquid state even after the ambient air temperature falls below thirty-two degrees Fahrenheit.

16 Claims, 10 Drawing Sheets

(56) References Cited

U.S. PATENT DOCUMENTS

| | | | | | |
|---|---|---|---|---|---|
| 2,394,672 | A | * | 2/1946 | Dykeman | 137/512.1 |
| 2,417,519 | A | * | 3/1947 | Forslind et al. | 405/61 |
| 2,511,291 | A | * | 6/1950 | Mueller | 366/181.5 |
| 2,611,707 | A | * | 9/1952 | Rourke et al. | 426/603 |
| 2,746,090 | A | * | 5/1956 | Hoover | 264/269 |
| 2,788,642 | A | * | 4/1957 | Burkhead et al. | 62/399 |
| 2,802,363 | A | * | 8/1957 | Ponsar | 73/866.1 |
| 3,045,984 | A | * | 7/1962 | Cochran | 366/340 |
| 3,235,234 | A | * | 2/1966 | Beaudoin | 261/24 |
| 3,271,968 | A | * | 9/1966 | Karnath | 62/59 |
| 3,452,966 | A | * | 7/1969 | Smolski | 261/77 |
| 3,481,365 | A | * | 12/1969 | Keen | 137/883 |
| 3,514,074 | A | * | 5/1970 | Self | 251/127 |
| 3,532,118 | A | * | 10/1970 | Young | 137/594 |
| 3,544,762 | A | * | 12/1970 | Eisler | 219/200 |
| 3,636,830 | A | * | 1/1972 | Watts | 404/2 |
| 3,685,534 | A | * | 8/1972 | Straitz, III | 137/171 |
| 3,870,236 | A | * | 3/1975 | Sahagun-Barragan | 239/542 |
| 3,920,044 | A | * | 11/1975 | Gruner | 137/625.3 |
| 3,941,350 | A | * | 3/1976 | Kluczynski | 251/127 |
| 3,978,891 | A | * | 9/1976 | Vick | 138/42 |
| 4,460,201 | A | * | 7/1984 | McGugan | 285/18 |
| RE32,197 | E | * | 7/1986 | Self | 251/127 |
| 4,678,368 | A | * | 7/1987 | Helversen | 405/118 |
| 4,693,633 | A | * | 9/1987 | Giordano | 405/119 |
| 4,715,395 | A | * | 12/1987 | Mainelli et al. | 138/42 |
| 4,741,645 | A | * | 5/1988 | Butler | 405/118 |
| 4,798,475 | A | * | 1/1989 | Strandberg | 366/160.5 |
| 4,982,527 | A | * | 1/1991 | Sprung | 47/59 R |
| 5,096,577 | A | * | 3/1992 | Ngo et al. | 210/151 |
| 5,205,592 | A | * | 4/1993 | Ziu | 285/45 |
| 5,207,386 | A | * | 5/1993 | Mehoudar | 239/542 |
| 5,255,997 | A | * | 10/1993 | Bailey et al. | 405/16 |
| 5,256,281 | A | * | 10/1993 | Ngo et al. | 210/151 |
| 5,342,512 | A | * | 8/1994 | Ngo et al. | 210/151 |
| 5,366,322 | A | * | 11/1994 | Hurwitt | 405/52 |
| 5,366,323 | A | * | 11/1994 | Nicholson | 405/119 |
| 5,505,027 | A | * | 4/1996 | Young | 52/169.5 |
| 5,511,351 | A | * | 4/1996 | Moore | 52/302.1 |
| 5,564,860 | A | * | 10/1996 | Amann | 405/118 |
| 5,568,995 | A | * | 10/1996 | Beamer | 405/119 |
| 5,735,638 | A | * | 4/1998 | Beamer | 405/119 |
| 5,772,361 | A | * | 6/1998 | Gavin | 405/36 |
| 5,806,252 | A | * | 9/1998 | Scuero | 52/169.7 |
| 5,829,246 | A | * | 11/1998 | Abrams et al. | 60/761 |
| 5,876,151 | A | * | 3/1999 | Brown et al. | 405/52 |
| 5,909,982 | A | * | 6/1999 | Takada et al. | 405/52 |
| 5,967,658 | A | * | 10/1999 | Mohajer | 366/337 |
| 6,152,650 | A | * | 11/2000 | Heine | 405/36 |
| 6,164,870 | A | * | 12/2000 | Baruh | 405/114 |
| 6,168,415 | B1 | * | 1/2001 | Pleasant et al. | 425/552 |
| 6,213,453 | B1 | * | 4/2001 | Ou | 261/78.1 |
| 6,325,570 | B1 | * | 12/2001 | Pohjamo | 405/81 |
| 6,328,890 | B1 | * | 12/2001 | Thibault | 210/532.2 |
| 6,336,771 | B1 | * | 1/2002 | Hill | 405/79 |
| 6,382,233 | B1 | * | 5/2002 | Yandle, II | 137/68.23 |
| 6,484,453 | B2 | * | 11/2002 | Nocella | 52/24 |
| 6,497,533 | B2 | * | 12/2002 | DeGarie | 405/52 |
| 6,523,572 | B1 | * | 2/2003 | Levin et al. | 138/37 |
| 6,533,497 | B2 | * | 3/2003 | Gunter | 405/118 |
| 6,692,186 | B1 | * | 2/2004 | Suazo et al. | 405/36 |
| 6,694,678 | B2 | | 2/2004 | Schneider | |
| 6,706,096 | B2 | * | 3/2004 | Sanglerat et al. | 95/274 |
| 6,722,818 | B1 | * | 4/2004 | Suazo et al. | 405/121 |
| 6,752,795 | B2 | * | 6/2004 | Cull | 604/323 |
| 6,755,596 | B2 | * | 6/2004 | Schibi | 405/270 |
| 6,854,926 | B2 | * | 2/2005 | Siglin et al. | 405/52 |
| 6,942,423 | B2 | * | 9/2005 | Davis | 405/81 |
| 6,942,424 | B2 | * | 9/2005 | Charon | 405/118 |
| 6,997,205 | B2 | * | 2/2006 | Kocek | 137/15.01 |
| 7,051,480 | B1 | | 5/2006 | Dennis | |
| 7,073,976 | B1 | * | 7/2006 | Webb | 405/52 |
| 7,156,580 | B2 | * | 1/2007 | Suazo et al. | 405/118 |
| 7,192,217 | B2 | * | 3/2007 | Hanna et al. | 405/28 |
| 7,470,085 | B1 | * | 12/2008 | Suazo | 405/49 |
| 7,758,282 | B2 | * | 7/2010 | Suazo | 405/118 |
| 7,878,231 | B2 | * | 2/2011 | Akiyama et al. | 165/41 |
| 8,372,277 | B2 | * | 2/2013 | Kania et al. | 210/151 |
| 8,439,602 | B1 | * | 5/2013 | Suazo | 405/118 |
| 2002/0094238 | A1 | * | 7/2002 | Schibi | 405/118 |
| 2005/0025572 | A1 | * | 2/2005 | Sanfilippo et al. | 405/36 |
| 2005/0271472 | A1 | * | 12/2005 | Charon | 405/118 |
| 2006/0072971 | A1 | * | 4/2006 | Suazo et al. | 405/119 |
| 2006/0280558 | A1 | * | 12/2006 | Hankinson | 405/118 |
| 2009/0221990 | A1 | * | 9/2009 | Jaeb et al. | 604/540 |
| 2012/0222769 | A1 | * | 9/2012 | Bhopte et al. | 138/42 |
| 2013/0118625 | A1 | * | 5/2013 | Bell | 138/37 |

* cited by examiner

APPARATUS AND METHOD FOR LIMITING ICE FORMATION

BACKGROUND

In many regions of the world the formation of ice on walkways and driveways creates slippery and hazardous conditions during winter months. The ice typically forms when temperatures rise above freezing to melt accumulated snow, such as on a rooftop, then fall below freezing to turn the melted snow into ice, specifically near a downspout or gutter.

There is therefore a need for a device to help reduce the formation of ice on pedestrian walkways and roadways adjacent to downspout and gutter locations.

SUMMARY

The present invention comprises an apparatus for helping to reduce the formation of ice on walkways and roads. The invention generally includes a container adapted to receive a solid ice prevention composition such as salt pellets. The container has an entrance opening and an exit opening. The entrance opening of the container may be connected to a downspout directly or via a connecting member to direct water from the downspout into the container. Water enters the container through the entrance opening and dissolves the ice prevention composition to create a solution having a reduced freezing point. The solution exits the container through the exit opening where it is able to flow in its liquid state even after the ambient air temperature falls below thirty-two degrees Fahrenheit. If the walkway and/or roadway is designed correctly with a descending grade for water runoff, and the ambient air temperature does not drop below the reduced freezing point of the solution before the solution flows to a drain or grassy area, then the device can help prevent the formation of a dangerous icy condition.

DETAILED DESCRIPTION

Figure 1:
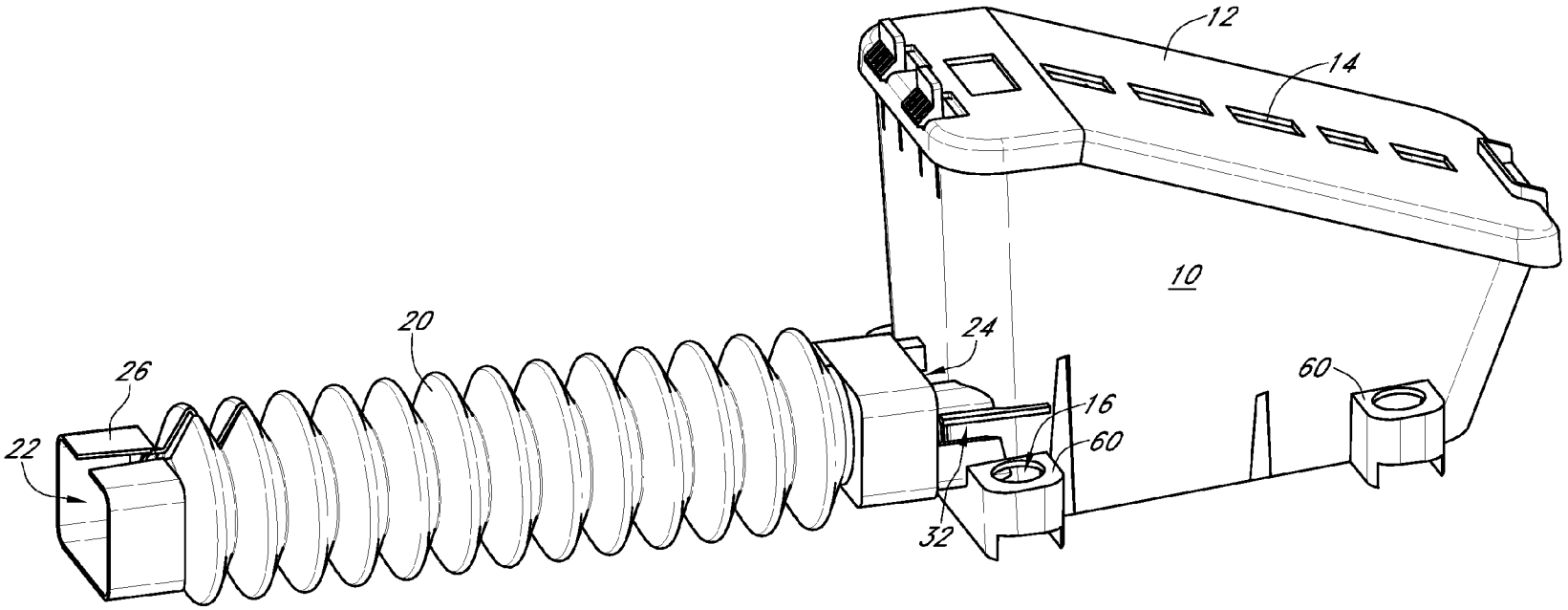
FIG. 1 is a perspective view of an embodiment of the invention.

The present invention comprises a device for helping to reduce the formation of ice on walkways, roads, and other ground surfaces. As shown in FIG. 1, the invention generally includes a container 10 adapted to receive a solid ice prevention composition 46 adapted to lower the freezing point of water to help prevent ice formation. Any suitable water soluble ice prevention composition may be used, including, calcium chloride pellets, calcium chloride flake, calcium magnesium acetate, magnesium chloride pellets, magnesium chloride flake, potassium chloride, and sodium chloride (salt) pellets.

Figure 3:
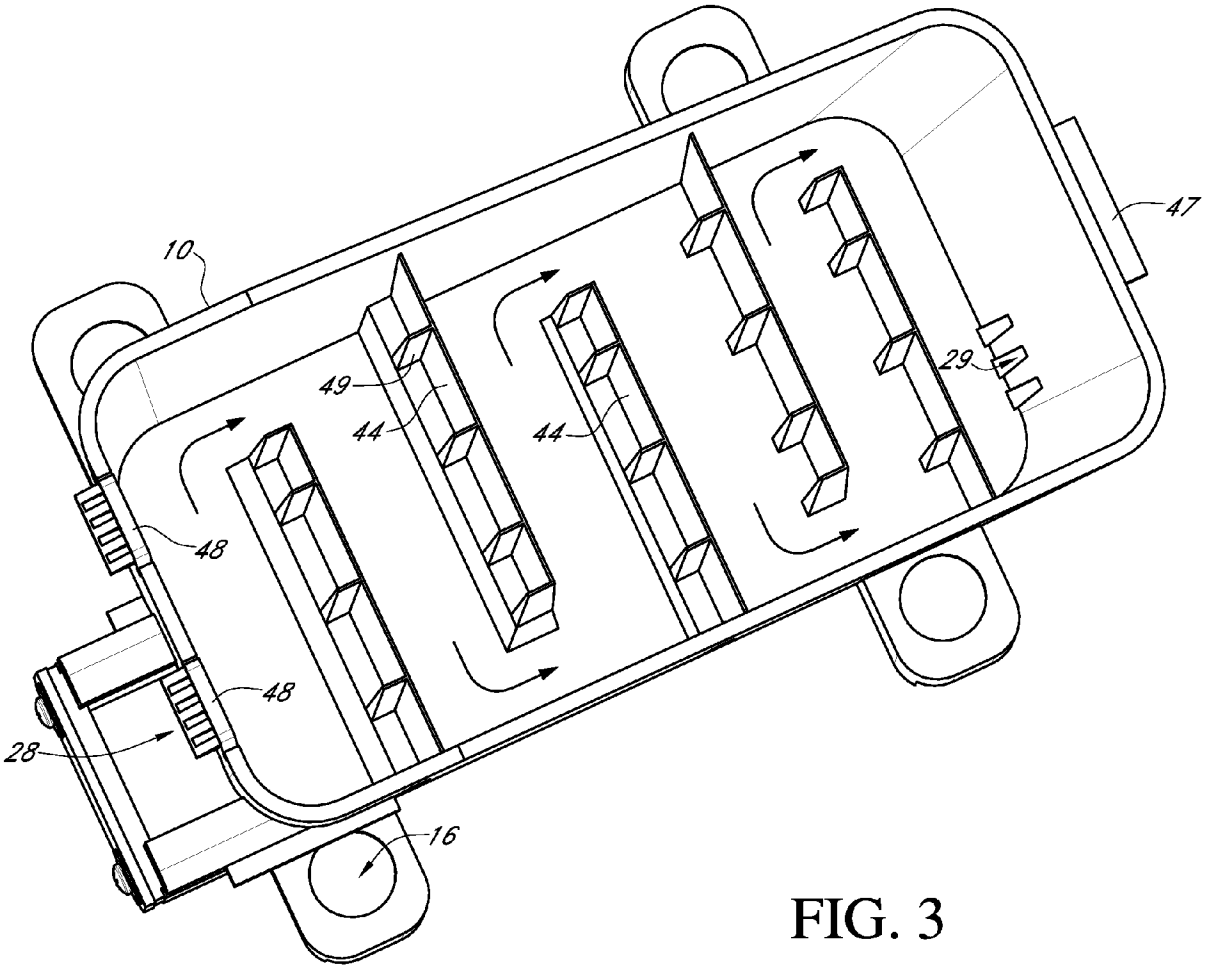
FIG. 3 is a top view of the container with its lid removed.
Figure 5:
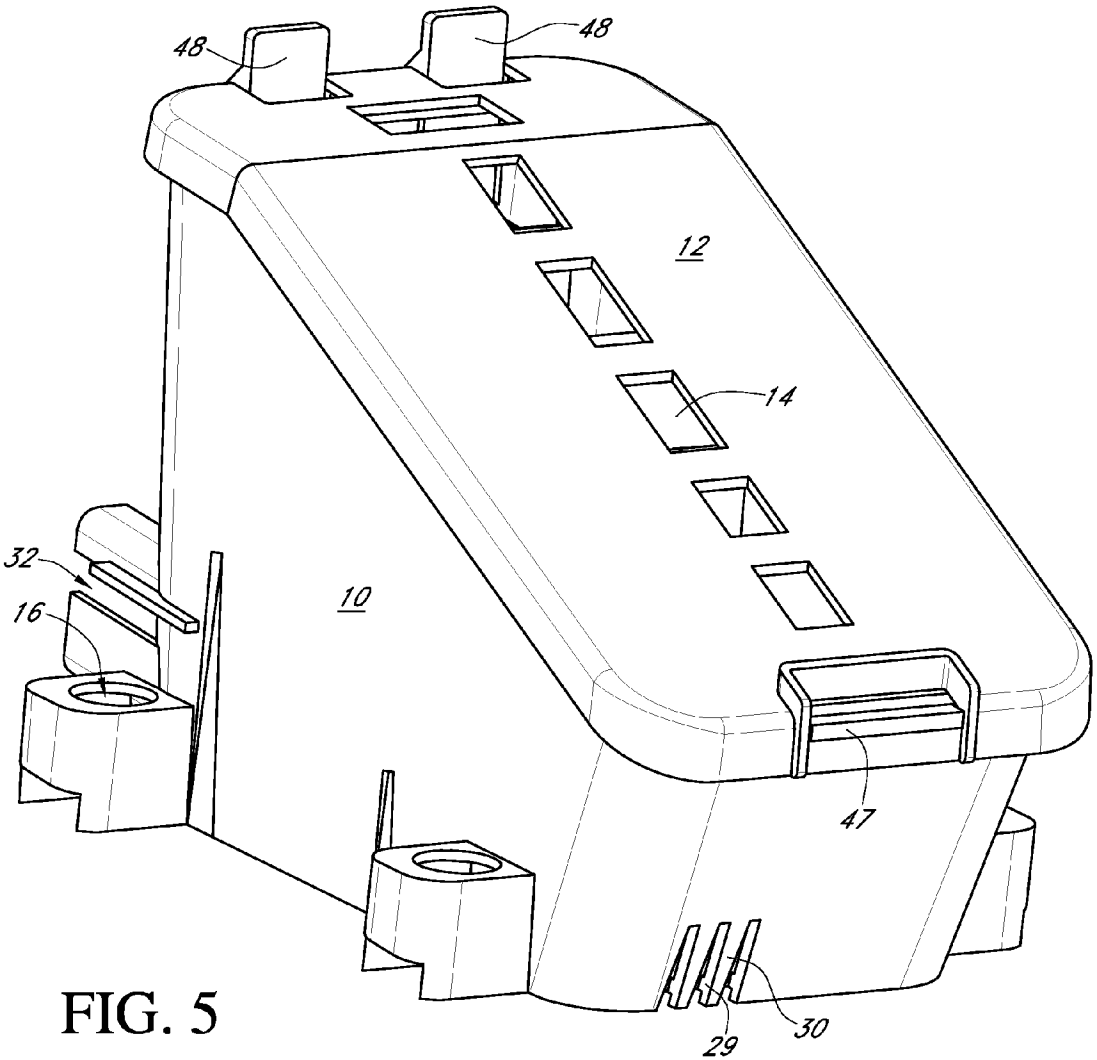
FIG. 5 is a front perspective view of the container.
Figure 6:
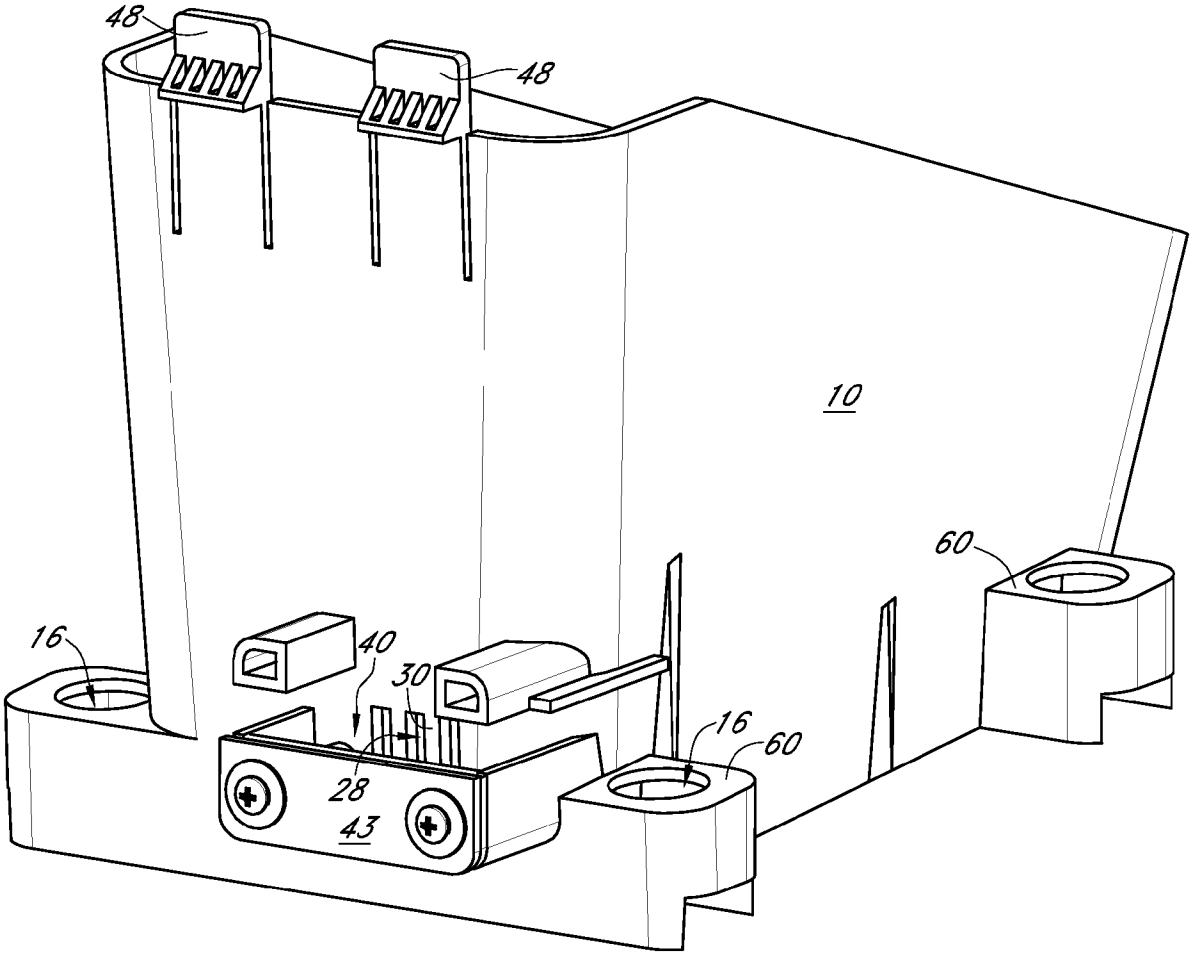
FIG. 6 is a rear perspective view of an embodiment having a water collection area.
Figure 7:
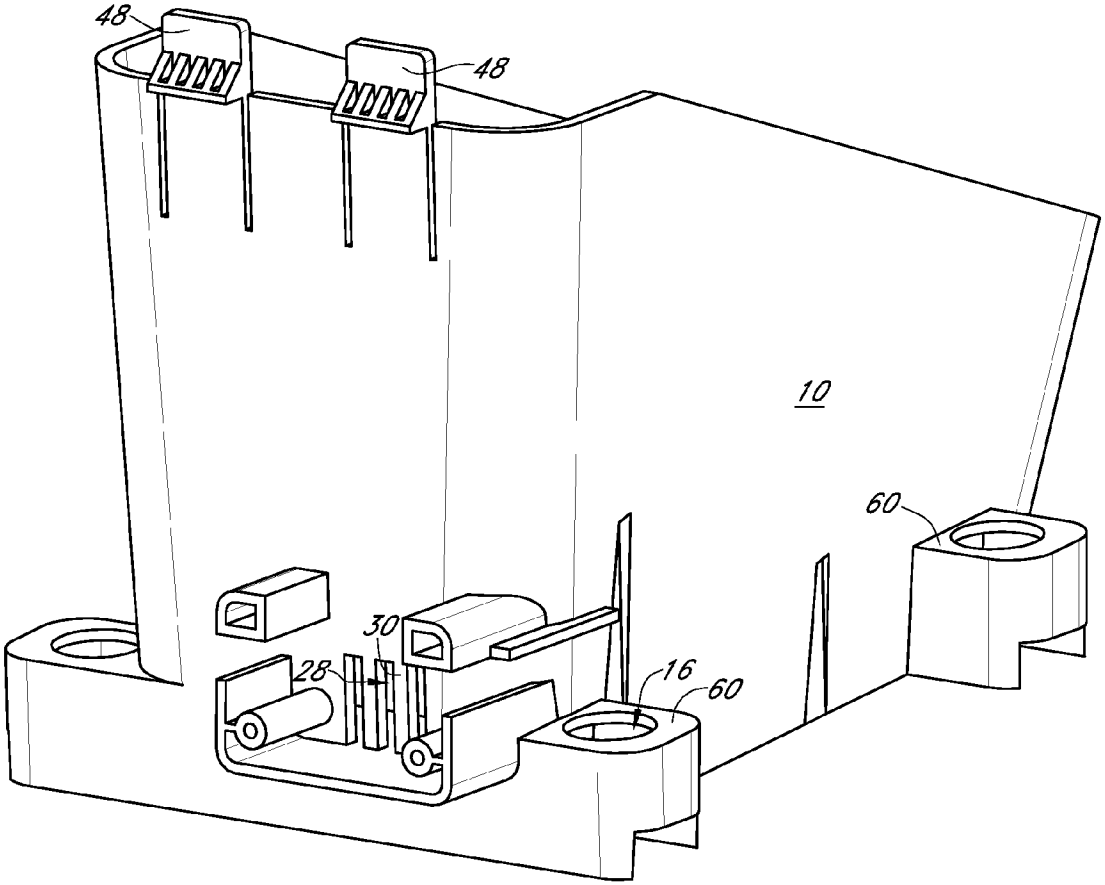
FIG. 7 is a rear perspective view of an embodiment wherein a downspout or connecting member (not shown) combines directly to the container.

As shown best in FIG. 3, the container 10 has an entrance opening 28 and an exit opening 29. The entrance opening 28 may be in one of the sides or in the top of the container 10 and may be at any suitable elevation. The exit opening 29 could be in one of the sides or in the bottom/floor 42 of the container 10 and is preferably near the intersection of one of the sides and the floor 42. As shown in FIGS. 5, 6, and 7, the openings 28, 29 may comprise retention members 30 to help prevent the ice prevention composition 46 from exiting the container 10 before it has been dissolved in the water. The retention members 30 may be vertical slats, horizontal slats, screens, or mesh. FIG. 6 shows an embodiment wherein the container 10 comprises a water collection area 40 on the outside of the container 10. This embodiment is useful in situations where water is dripping from a pipe or rooftop since the water collection area 40 serves as a reservoir for collecting the dripping water and directing it into the container 10. The entrance opening 28 of the container 10 may be connected to a downspout directly or via a connecting member 20 to direct water from the downspout into the container. Various embodiments of the connecting member 20 are described below. FIG. 7 shows an embodiment where wall 43 (shown in FIG. 6) is removed to allow a downspout or connecting member 20 to attach to the container 10.

Figure 9:
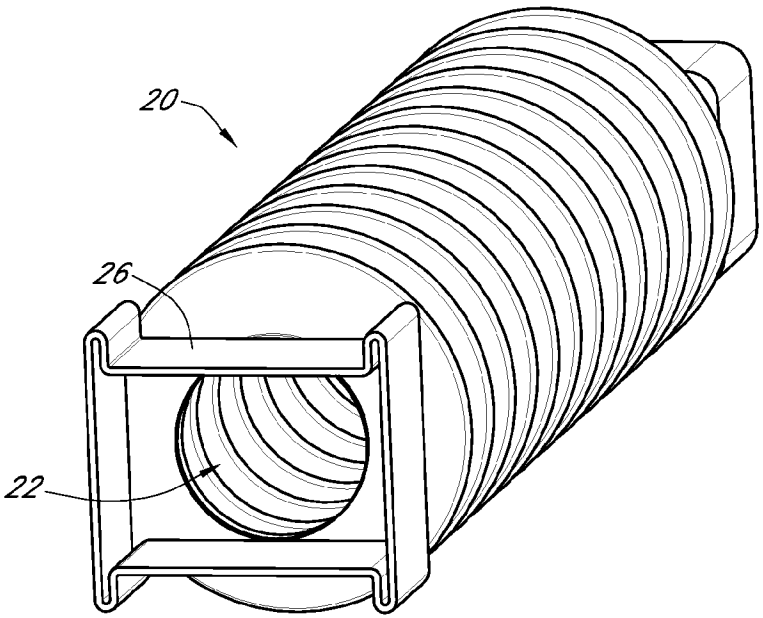
FIG. 9 is a perspective view of a second embodiment of the connecting member.
Figure 8:
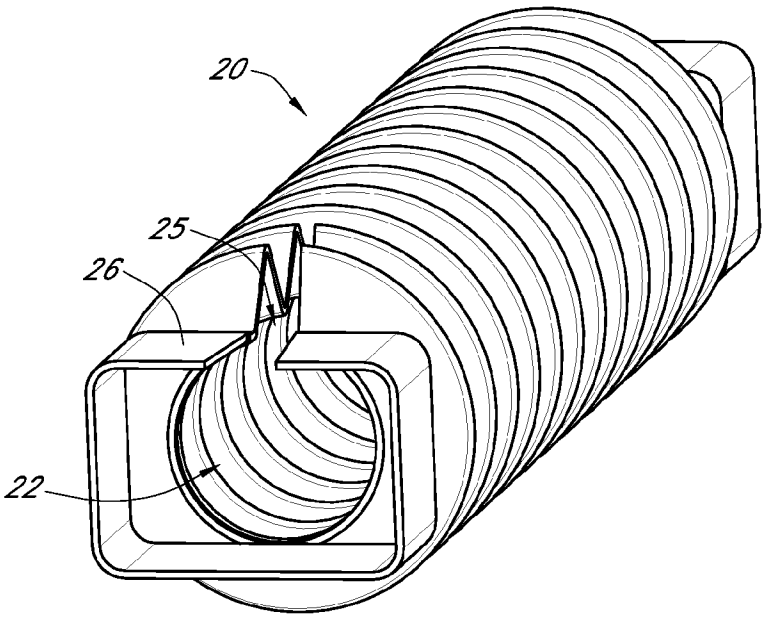
FIG. 8 is a perspective view of a first embodiment of the connecting member.
Figure 10:
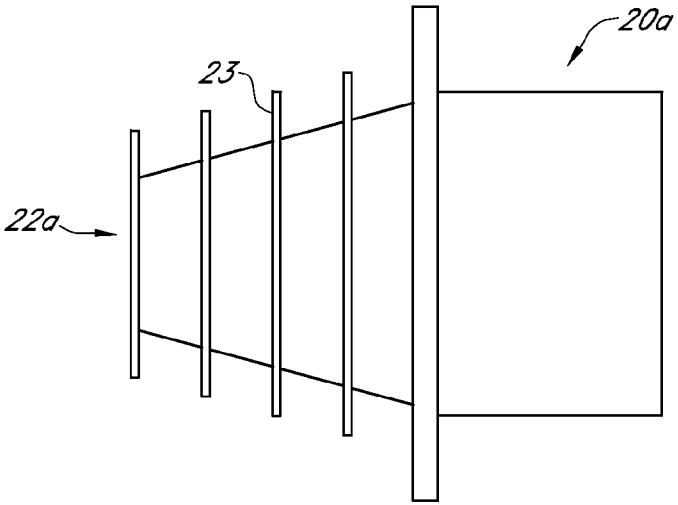
FIG. 10 is a perspective view of a third embodiment of the connecting member.

As discussed above, there are several means by which water can be directed into the container 10. In some embodiments, a connecting member 20 having an opening through its longitudinal axis is used to direct water from a gutter or downspout into the container 10. FIGS. 8, 9, and 10 shows different embodiments of connecting members 20 that may be used. In the embodiments shown, the connecting members 20 are constructed in an accordion style which allows them to be laterally flexible as well as selectively lengthened or shortened as required for each particular situation. The connecting member 20 has an opening in its first end 22 for receiving water from the gutter or downspout and an opening in its second end 24 adapted to connect with the container 10. If the downspout is small enough, the downspout can simply be placed inside the opening in the first end 22 of the connecting member 20. FIGS. 8 and 9 show a connecting member 20 embodiment having a semi-rigid flange 26 around the first end 22. The flange 26 is biased in its smaller position but able to be stretched to a larger position wherein it can be placed over larger male downspouts. The embodiment shown in FIG. 8 further comprises a cut or slit 25 in the top of the connecting member 20 to allow the first end 22 to open and stretch to an even larger size for fitting over extremely large downspouts. In some embodiments the semi-rigid flange 26 is made of rubber. In use, it is desirable to secure the connecting member 20 to the downspout. In some embodiments, this is done by cinching the flange 26 tightly around the downspout using a cable tie, tape, mechanical fastener, or other suitable device.

FIG. 10 shows another connecting member 20*a* embodiment wherein the first end 22*a* of the connecting member 20*a* comprises one or more retention flanges 23 which extend radially outward from the longitudinal axis of the connecting member 20*a*. The first end has retention flanges 23 which are adapted to be inserted into a downspout or drainage opening to help ensure the water flows from the drainage opening into the connecting member 20*a* and toward the container 10. In some embodiments, the end portion (and/or the distance that the retention flanges 23 extend outward from the longitudinal axis) is tapered becoming narrower toward the first end 22. The tapered construction provides adjustability by allowing the connecting member 20*a* to be inserted into openings of different diameters, i.e. the connecting member 20*a* can be inserted farther into openings with larger diameters to still provide a tight fit. This embodiment is useful when a structure such as a building or fuel island canopy has an internal or hidden downspout with a female exit opening without a male pipe or tube extending from the opening. In this situation, the connecting member 20 shown in FIG. 10 can be inserted into the female opening to direct the water into the connecting member 20*a*. The retention flanges 23 help retain the connecting member 20*a* inside the opening. In some embodiments the component shown in FIG. 10 is a separate connector that that may be used with other connecting members 20 by inserting connecting member 20*a* into the opening of the first end 22 of another connecting member 20. In other embodiments connecting member 20*a* may be combined directly with the entrance opening 28 of the container 10.

It is important to prevent too much water from entering the container 10 because a high volume of water or high flow rate through the container 10 could prevent the water from thoroughly mixing with the ice prevention composition 46 and achieving its desired reduced temperature condition. Further, high flow rates likely indicate that the device is not presently needed due to high ambient air temperatures. The walls of the water collection area 40 are approximately only as tall as the entrance opening 28 to allow water to spill over the walls (and not enter the container 10) on days when it is raining or when lots of melting is occurring and water is traveling at a fast rate. As shown in FIG. 1, an overflow opening 32 allows water to spill over the walls (and not enter the container 10) even when the connecting member 20 is attached to the container 10. This helps to conserve the ice prevention composition 46 inside the container 10 by lowering the volume of water flowing through the container 10 at times when reducing the freezing point of water is not necessary.

Figure 2:
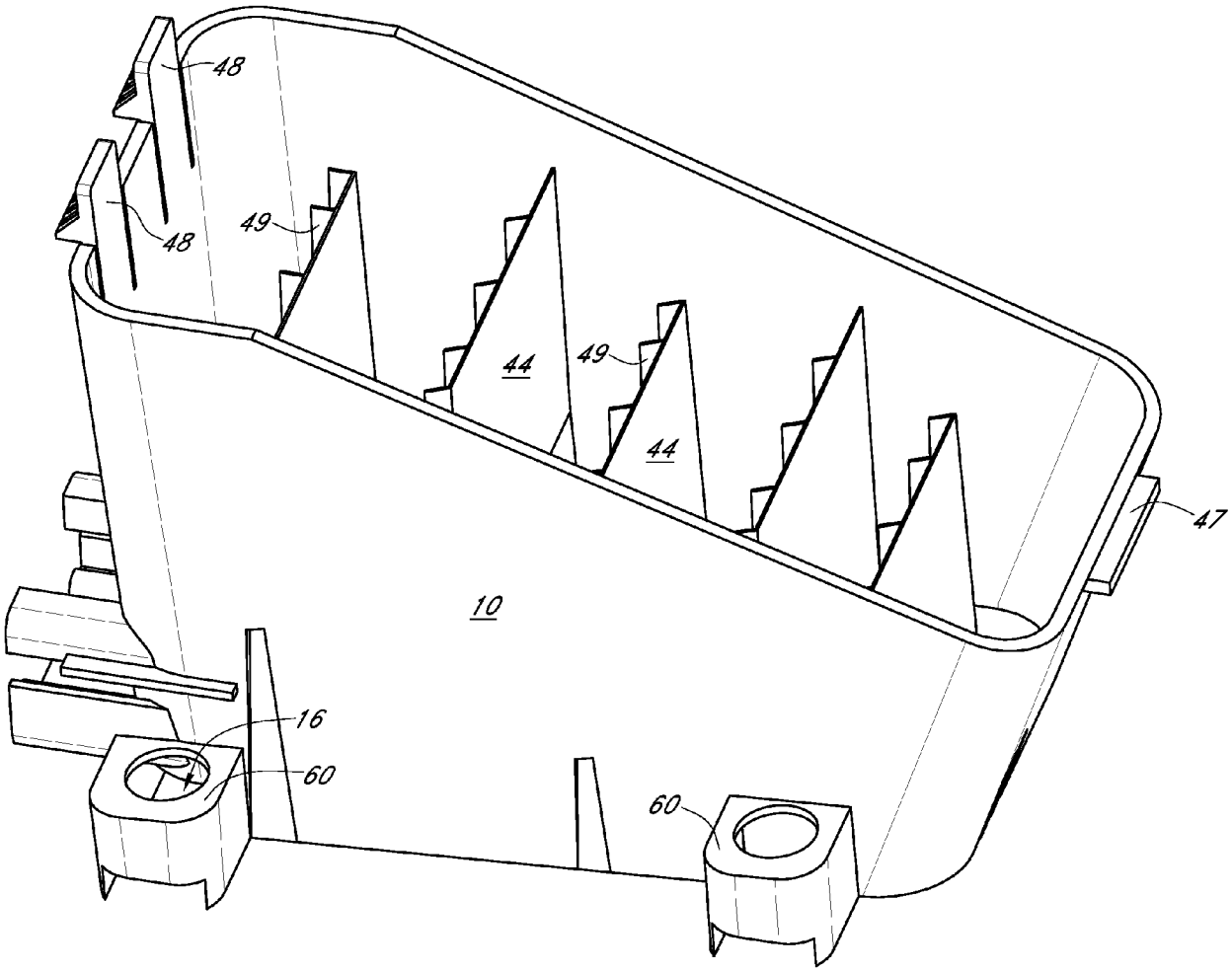
FIG. 2 is a perspective view of the container with its lid removed.
Figure 4:
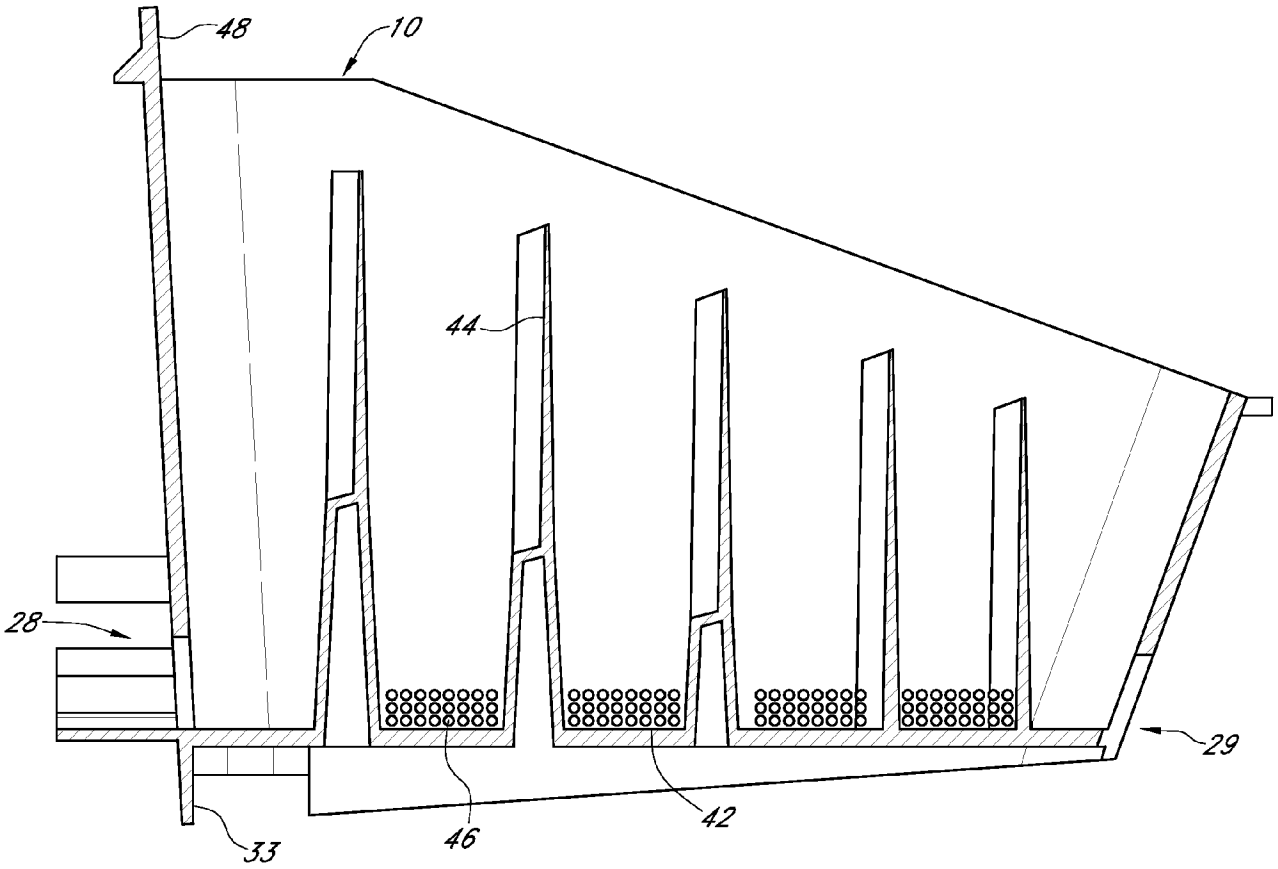
FIG. 4 is a side view of the container with the wall cutaway to show the internal baffles.

Water enters the container 10 through the entrance opening 28 and dissolves the ice prevention composition 46 to create a solution having a reduced freezing point. The ice prevention composition 46 is spread over the floor 42 of the container 10. It can be beneficial to fill the container 10 with a significant amount of ice prevention composition 46 so that the water flows through a lower layer of the ice prevention composition 46. As the lower layer of ice prevention composition 46 dissolves, an upper layer will move downward in gradual stages to replace the lower layer. FIGS. 2, 3, and 4 show the container 10 with its lid 12 removed. FIG. 3 shows an embodiment wherein baffles 44 extend upward from the floor 42 in a staggered fashion to force the water/solution to travel through the container 10 in a serpentine manner as shown by the arrows in FIG. 3. The horizontal serpentine flow pattern forces the water/solution to have more residence time within the container absorbing more ice prevention composition 46. In one embodiment, the serpentine flow path along the floor 42 is between twenty and twenty-five inches from entrance opening 28 to exit opening 29. In a preferred embodiment, the flow path is twenty- two and a half inches from entrance opening 28 to exit opening 29. In some embodiments the baffles have rough surfaces or rib members 49 (FIG. 3) to help prevent the ice prevention composition 46 from traveling downstream with the flowing water/solution. As shown in the embodiment of FIG. 3, the rib members 49 extend perpendicularly outward from the longitudinal axis of the baffles 44 (which is also perpendicular to the primary flow path of the water/solution).

In order to keep the water/solution flowing from the entrance opening 28 toward the exit opening 29, the water flow path is angled toward the exit opening 29 such that the elevation of the floor 42 lowers as the water/solution nears the exit opening 29. This reduction in elevation is best shown in FIG. 4. The angle may be achieved by any suitable means. In some embodiments the container 10 is constructed such that the floor 42 is generally horizontal when the container 10 is sitting on flat/horizontal ground. In this embodiment, the entrance opening 28 side of the container 10 may be propped up by a rock, piece of lumber or other suitable object during use to make it higher than the exit opening 29 side of the container 10. A variation of this embodiment comprises a height adjustment mechanism 33 extending from the underside of the container 10 near its entrance opening 28 side to selectively raise the elevation of the entrance opening 28 side of the container 10. In another embodiment, the floor 42 is horizontally level, however, the entrance opening 28 is higher in elevation than the exit opening 29. In another embodiment, the container 10 is constructed such that the underside of the container 10 body has a higher elevation at its entrance opening 28 side. In yet another embodiment, the floor 42 is positioned within the container 10 to have a higher elevation at the entrance opening 28 side than the exit opening 29 side. In some embodiments the floor 42 is angled at about between 3-8 degrees relative to the horizontal plane.

The angle of the floor 42 and/or the relative heights of the entrance opening 28 and exit opening 29 is important because it affects the speed at which the water/solution flows through the container 10. If the water/solution flows too slowly, the water may absorb too much ice prevention composition 46 thereby negating the freezing point lowering affects of the composition 46. Conversely, if the water/solution flows too fast through the container 10, the water may not absorb enough ice prevention composition 46 to lower the freezing point of the water to an appropriate temperature. Thus, if the ground surface is not completely level, the container 10 may need to be leveled by raising one of its ends. Some embodiments of the device include a first and second spaced apart horizontal leveling surface 60. A bubble level of other suitable leveling device can be placed on one or both of these surfaces 60 to determine whether the container 10 is horizontally positioned to allow the water/solution to flow through the container 10 at the appropriate speed.

Applicants created a prototype similar to the device shown in FIG. 3 to perform experiments. In one experiment, water entered the device at a temperature of about 36.9 degrees Fahrenheit at a rate of about 2.03 gallons/hour. In this experiment, large pellets of water softener salt with Resin Kleen® covered the entire floor 42 of the container. The first quart of water exiting the container 10 had a freezing point of 3 degrees Fahrenheit. The second quart of water exiting the container 10 had a freezing point of 5 degrees Fahrenheit. The third quart of water exiting the container 10 had a freezing point of 6 degrees Fahrenheit. The fourth quart of water exiting the container 10 had a freezing point of 7 degrees Fahrenheit.

As best shown in FIG. 5, the solution exits the container through the exit opening where it is able to flow in its liquid state even after the ambient air temperature falls below thirty-two degrees Fahrenheit. In other words, the water that entered the container has absorbed the ice prevention composition 46 to create a solution with a freezing point lower than regular water. It is important that the solution exiting the container 10 contain the proper concentration of ice prevention composition 46 so that it achieves its lowest possible freezing point. As discussed above, one way to help ensure the proper concentration is reached is to allow the water to spend the proper residence time inside the container 10 and in contact with the ice prevention composition 46.

Some embodiments have a removable lid 12 as shown best in FIGS. 1 and 5. The lid 12 may be combined with the container 10 in any suitable fashion, including mechanically or by an interference fit. As shown, the exit opening 29 side of the container 10 has a protruding member 47 adapted to be placed through an opening on the lid 12. Retention members 48 on the entrance opening 28 side of the container 10 have a lock position and an unlock position. In the unlock position the retention members 48 can be moved to allow the lid 12 to be placed on or removed from the container 10. In the lock position the retention members 48 secure the lid 12 to the container 10. The lid 12 may comprise one or more windows 14 which allows the user to view the inside of the container 10 to determine whether more ice prevention composition 46 needs to be added and whether the water is flowing properly. The window 14 is an opening that may have a transparent covering made from plastic or glass to prevent snow and rain from entering the container 10 through the window 14. In other embodiments, the window 14 may be located in one of the walls of the container 10.

As shown best in FIG. 6, some embodiments comprise one or more security openings 16 combined with the container 10. These security openings 16 are adapted to receive a cable, rope, chain, or other suitable member that can be secured around a post or other stationary object to help secure the container 10 to prevent theft.

Figure 11:
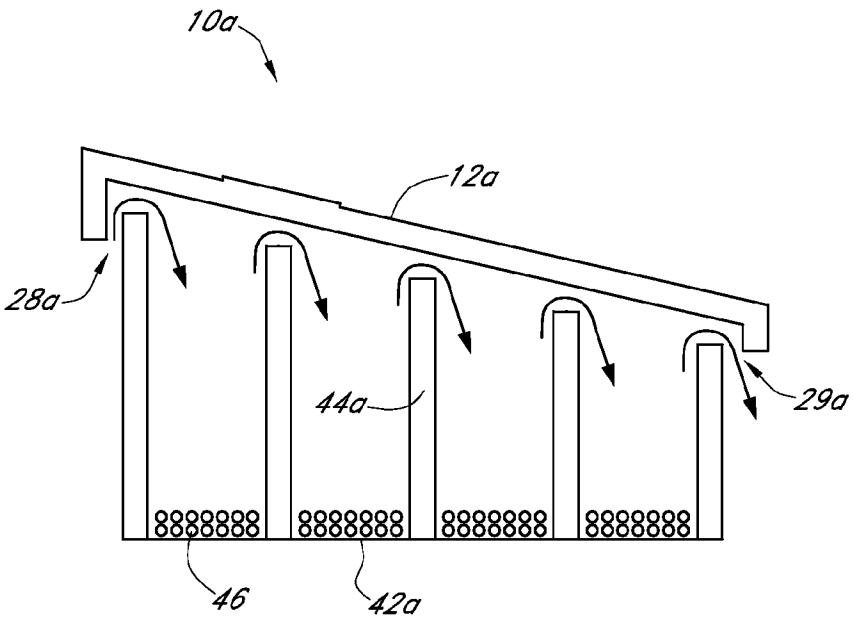
FIG. 11 is a side view of an alternate embodiment of the container wherein the water cascades over the top of the baffles.
Figure 12:
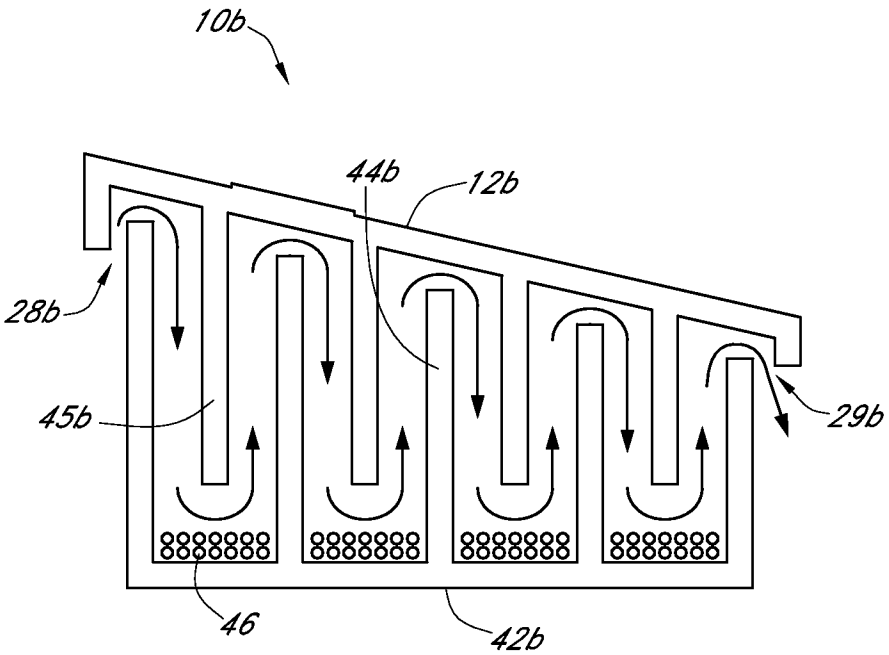
FIG. 12 is a side view of another alternate embodiment similar to FIG. 11.

FIG. 11 shows an alternate embodiment wherein the baffles 44*a* extend across the entire width of the container 10*a* thereby requiring the water/solution to cascade over each successive baffle 44*a* before exiting the container 10*a* as shown by the arrows. The baffles 44 become successively shorter towards the exit opening 29*a* end of the container 10*a* to help keep the water/solution moving towards the exit opening 29*a* instead of the entrance opening 28*a*. Ice prevention composition 46 is placed on the floor 42*a* of the container 10*a* between each baffle 44*a* thereby allowing the water to absorb the ice prevention composition 46 as it moves towards the exit opening 29. FIG. 12 shows an alternate embodiment similar to FIG. 11 further comprising inverse baffles 45*b* which extend from the top downward towards the floor 42*b*. In some embodiments, the inverse baffles 45*b* may be combined with the lid 12*b*, in other embodiments the inverse baffles 45*b* may be combined with the walls of the container 10. The arrows in FIG. 12 show how the inverse baffles 45*b* force the water/solution downward toward the floor 42*b* of the container lob after cascading over each successive baffle 44*b* to create a vertical serpentine flow path help the water/solution mix with the ice prevention composition 46.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. A device for helping to prevent the formation of ice on a ground surface, said device comprising:

A container having a first side with an entrance opening therein and a second side with an exit opening therein, wherein the first side and second side are connected by a floor;

A plurality of baffles extending upward from the floor in a staggered arrangement to create a horizontal serpentine water flow pathway along the floor of the container;

A water soluble solid ice prevention composition in the container along the serpentine water flowpathway;

A connector having a first end with a first opening adapted to be combined with a downspout and a second end with a second opening combined with the entrance opening of the container;

A semi-rigid flange around the first opening, said semi-rigid flange having a first position and a first position and a second position wherein the size of the first opening is larger in the semi-rigid flange second position than in the semi-rigid flange first position, said semi-rigid flange being biased in the first position;

Wherein the connector is movable between a lengthened position and a shortened position, wherein the lengthen position has a first distance between the first end and the second end and the shortened position has a second distance between the first end and the second end, wherein the first distance is longer than the second distance.

2. The device of claim 1 wherein the entrance opening is higher in elevation than the exit opening.

3. The device of claim 1 wherein the floor is higher in elevation at the first side than at the second side.

4. The device of claim 3 wherein the floor is angled at about between 3-8 degrees relative to horizontal.

5. The device of claim 1 wherein the container is adapted to allow water to enter through the entrance opening and dissolve the ice prevention composition to create a solution having a reduced freezing point.

6. The device of claim 1 wherein each baffle of the plurality of baffles further comprise ribs extending outward therefrom to help prevent the ice prevention composition from migrating clown the serpentine water flow pathway.

7. The device of claim 1 wherein the entrance opening further comprises retention members to help prevent the ice prevention composition from prematurely exiting the device.

8. The device of claim 1 wherein the exit opening further comprises retention members to help prevent the ice prevention composition from prematurely exiting the device.

9. The device of claim 1 wherein the serpentine water flow pathway is between about twenty and twenty-five inches from the entrance opening to the exit opening.

10. The device of claim 1 further comprising a removable lid for selectively covering the container.

11. The device of claim 10 wherein the lid further comprises a window.

12. The device of claim 1 wherein the container further comprises a window.

13. A device for helping to prevent the formation of ice on a ground surface, said device comprising:

A container having a first side with an entrance opening therein and a second side with an exit opening therein, wherein the first side and second side are connected by a floor;

A plurality of baffles extending upward from the floor in a staggered arrangement to create a horizontal serpentine water flow pathway along the floor of the container;

A water soluble ice prevention composition in the container along the serpentine water flow pathway;

A connector having a first end with a first opening adapted to be combined with a downspout and a second end with a second opening combined with the entrance opening of the container;

A semi-rigid flange around the first opening, said semi-rigid flange having a first position and a second position wherein the size of the first opening is larger in the semi-rigid flange second position than in the semi-rigid flange first position, said semi-rigid flange being biased in the first position;

Wherein the connector is movable between a lengthened position and a shortened position, wherein the lengthened position has a first distance between the first end and the second end and the shortened position has a second distance between the first end and second end, wherein the first distance is longer than the second distance;

Wherein the connector comprises a slit beginning at the first end and extending longitudinally along a predetermined length of the connector to allow the first end to be stretched to a larger size.

14. The device of claim 1 wherein the container further comprises an inside, an outside, and a water collection area on the outside of the container adjacent to the entrance opening, said water collection area for collecting water before it enters the device through the entrance opening.

15. The device of claim 14 wherein the water collection area further comprises at least one wall for helping to retain water before it enters the container through the entrance opening, wherein the entrance opening has a top and there is a predetermined distance between the floor and the top of the entrance opening, wherein the at least one wall of the water collection area has a top and the distance between the floor and the top of the at least one wall is about the same as the predetermined distance.

16. The device of claim 14 wherein the water collection area further comprises an overflow opening for allowing water to drain out of the water collection area without entering the container.

* * * * *